US008701310B1

(12) United States Patent
Walsh

(10) Patent No.: US 8,701,310 B1
(45) Date of Patent: Apr. 22, 2014

(54) FLEXIBLE FOOTWEAR COVERING REDUCING FRICTION AND DRAG BETWEEN SHOES AND FLOOR SURFACES

(76) Inventor: Patricia Frances Walsh, Gaithersburg, MD (US)

( * ) Notice: Subject to any disclaimer, the term of this patent is extended or adjusted under 35 U.S.C. 154(b) by 645 days.

(21) Appl. No.: 12/858,350

(22) Filed: Aug. 17, 2010

Related U.S. Application Data

(60) Provisional application No. 61/234,448, filed on Aug. 17, 2009.

(51) Int. Cl.

| | |
|---|---|
| ***A43B 3/20*** | (2006.01) |
| ***A43B 5/18*** | (2006.01) |
| ***A43B 3/18*** | (2006.01) |
| ***A43C 15/00*** | (2006.01) |

(52) U.S. Cl.
CPC ... *A43B 5/18* (2013.01); *A43B 3/20* (2013.01); *A43B 3/18* (2013.01); *A43C 15/00* (2013.01)
USPC ..... 36/7.4; 36/7.2

(58) Field of Classification Search
CPC ..... A43B 5/18; A43B 3/16; A43B 3/18; A43B 3/20; A43B 3/163; A43B 23/02; A43B 23/0205; A43C 15/12; A43C 15/00; A43C 15/02; A41B 11/00
USPC ..... 36/7.2, 7.4, 2 R, 1.5, 7.1 R, 7.3, 4, 101
See application file for complete search history.

(56) References Cited

U.S. PATENT DOCUMENTS

| | | | | | |
|---|---|---|---|---|---|
| 293,475 | A | * | 2/1884 | King | 36/7.2 |
| 1,664,617 | A | * | 4/1928 | Friedenthal | 36/2 R |
| 2,171,654 | A | * | 9/1939 | Hinchliff et al. | 36/72 R |
| 2,420,618 | A | * | 5/1947 | Rabinovitz | 36/2 R |
| 2,447,284 | A | * | 8/1948 | Bolte et al. | 36/7.2 |
| 4,646,727 | A | * | 3/1987 | Chambers | 602/3 |
| 4,665,633 | A | * | 5/1987 | Edgerton | 36/2 R |
| 4,872,271 | A | * | 10/1989 | Allen | 36/72 B |

* cited by examiner

*Primary Examiner* — Ted Kavanaugh
(74) *Attorney, Agent, or Firm* — Whitham, Curtis, Christofferson & Cook, P.C.

(57) ABSTRACT

A flexible footwear covering that fits on a shoe, which has a lower coefficient of friction than the bottom of a shoe allowing for ease of motion on carpeted or other surfaces where the grip of the shoes worn inhibit movement. The covering is in the general shape of a sock with a non retractable or retractable ring, which lies within the arch of the bottom of the shoe giving the option to leave fully covered for maximum ease of movement or expose the heel for more traction when needed. In addition, the flexible footwear covering can be used as a fitness tool with or without the optional design of reinforced panels that are positioned at the toe, ball and/or heel on the outside of the shoe. With the reinforced panels, a variety of exercises can be done to strengthen various muscles of the upper and lower body in a supine or prone position.

2 Claims, 14 Drawing Sheets

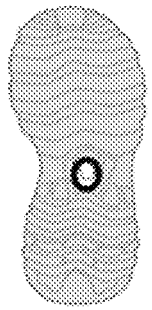
FIG. 3A
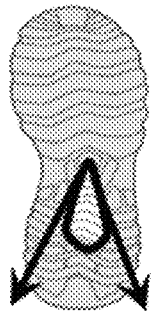
FIG. 3B
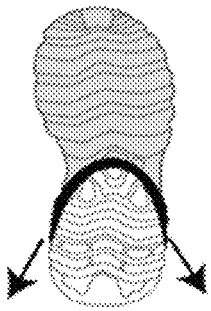
FIG. 3C
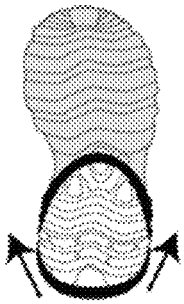
FIG. 3D
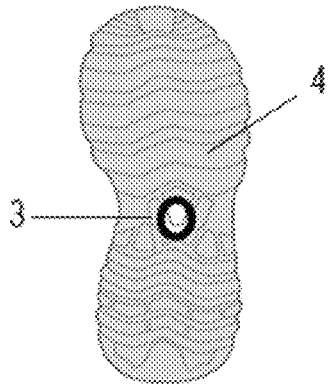
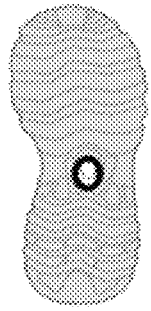
FIG. 3E
FIG. 3

FLEXIBLE FOOTWEAR COVERING REDUCING FRICTION AND DRAG BETWEEN SHOES AND FLOOR SURFACES

CROSS REFERENCE TO RELATED APPLICATIONS

This application claims the benefit of provisional patent application Ser. No. 61/234,448, filed on 2009 Aug. 17 by the present inventor.

FEDERALLY SPONSORED RESEARCH

Not Applicable

SEQUENCE LISTING OR PROGRAM

Not Applicable

1. Field of the Invention

Apparatuses consistent with the present invention relates to a flexible device, which fits over a shoe. More particularly, the present invention relates to a flexible shoe covering which reduces the friction and drag between shoes and carpeted surfaces allowing a wearer to move with ease and less risk of injury.

2. Description of the Related Art

Not Applicable.

BACKGROUND OF THE INVENTION

The fitness industry is very aware that moving or exercising on carpeted surfaces while wearing rubber soled or athletic shoes is difficult, compromising and dangerous. This problem occurs because athletic shoes are not designed to move freely on carpet. Specifically, athletic shoes provide too much grip on carpet and do not allow a wearer to turn, slide, twist, or pivot in order to move or to do exercises properly and safely. Such a strong grip can cause various injuries and put unnecessary stress and strain on the muscles and joints of the lower body. Those injuries including, but not limited to, the lower back, hips, knees and ankles because while a wearer tries to accomplish these various movements the shoe will stay stationary causing the wearer to move in an unnatural and potentially harmful way.

The home fitness and video games industries, in particular need to address this problem because the majority of their target market will use their instructional fitness or sport interactive games at home on carpeted surfaces. With the latest video game technology of motion recognition, more people than ever are choosing to stay home to workout, dance and even play sports. Can you imagine playing tennis or basketball on a carpeted court? But that's what the developers of these interactive games are asking you to do, which is dangerous, and they know it. They advertise their products by photographing people playing the games in their athletic shoes, which lessens the chance of injury and on hard wood and/or polished studio floors because it's safer and easier to move on than carpet.

This type of misleading advertising has been going on for decades with the origin of the home fitness industry. The choreography for the home fitness market is developed, taught and filmed from expensive wood polished studio/dance floors so no one gets hurt and can do the exercises properly. So why would the fitness industry ask those at home to do what they themselves will not do on carpeted surfaces? Because neither the fitness nor the entertainment video game industries know how to fix the problem of moving effectively and safely on carpet. Participants are not aware that it is neither their inability to learn nor their current level of physical fitness that is holding them back and causing potential injuries. It is the surface of the floor they are working on and the movements they trying to accomplish upon them.

By fixing this problem, the home fitness/game enthusiast can finally have a level playing field in trying to accomplish what is being asked from them. Once the dangers of moving on carpeted surfaces in athletic/rubber soled shoes are known by the general public, the implicated industries will not have to discontinue or go back and change their older products. By simply including and/or endorsing this small, lightweight, portable, convenient and invaluable device, they will have given their consumers the knowledge and the tool to overcome the obstacle of moving on carpeted surfaces.

Accordingly, it is an object of this invention, as embodied in the non-limiting and exemplary embodiments disclosed herein, to overcome or avoid these problems and provide a device, which allows a person to move and/or exercise safely and properly on carpet while any type of footwear.

SUMMARY OF THE INVENTION

Exemplary embodiments of the present invention address at least the above problems and/or disadvantages and other disadvantages not described above. In addition, the present invention is not required to overcome the disadvantages described above, and an exemplary embodiment of the present invention may not overcome any or all of the problems described above.

According to an aspect of the present invention, there is provided a flexible covering for use on shoes. A flexible material in the general shape of a sock has a top stretchable first ring and a smaller retractable bottom second ring. When the top ring and material is stretched around the toe and heel, the material continues around to the bottom of the shoe setting the second retractable ring in place at the arch of the shoe. The material that covers the bottom of the shoe has a lower coefficient of friction than the sole of the shoe allowing the wearer to move with ease on carpeted surfaces.

According to another aspect of the present invention, there is provided a flexible covering for use on shoes including a first ring which is fitted around the top of a shoe, a second ring located on the bottom of the shoe, and a material that extends from the first ring to the second ring, wherein the second ring is stretchable between a non-stretched configuration and a stretched configuration wherein the second ring is stretched over a heel of the shoe to allow more fraction to be obtained through the heel when necessary.

According to another aspect of the present invention, there is provided a flexible covering for use on shoes including a first ring which is fitted around the top of a shoe, a second ring located on the bottom of the shoe, and a material that extends from the first ring to the second ring, wherein reinforcement is provided on portions of the covering which correspond to a toe and or heel of the shoe allowing for specific exercises to be accomplished or modified from a prone or supine position on carpeted surfaces.

According to another aspect of the present invention, there is provided a flexible covering for use on shoes including a first ring which is fitted around the top of a shoe, a second ring located on the bottom of the shoe, and a material that extends from the first ring to the second ring, wherein the second ring is stretchable but not retractable between a non-stretched configuration and a stretched configuration wherein the second ring is stretched over a heel of the shoe to allow fraction through the heel to be maintained.

According to another aspect of the present invention, there is provided a flexible covering for use on shoes including a first ring which is fitted around the top of a shoe, a second ring located on the bottom of the shoe, and a material that extends from the first ring to the second ring, wherein reinforcement is provided on portions of the covering which correspond to the toe and or ball of the shoe and has a lower coefficient of friction than the bottom of the shoe and the material covering the shoe, wherein the second ring is stretched over a heel of the shoe allowing for heel traction to be obtained and reinforcement to be only at the toe and or ball of the shoe providing a extra level of lower coefficient of friction than the bottom of the shoe and floor. Such in the case of, but not limited to, dancers who need a spot in which to spin allowing them to practice on a carpeted or other surface where the grip of the shoes worn would create too much grip to practice safely.

According to another aspect of the present invention, there is provided a flexible covering for use on shoes including a first ring which is fitted around the top of a shoe, a second ring located on the bottom of the shoe, and a material that extends from the first ring to the second ring, wherein reinforcement is provided on portions of the covering which correspond to the toe and or ball of the shoe and has a lower coefficient of friction than the bottom of the shoe and the material covering the shoe, wherein the second ring has a stabilization patch to hold the second ring in place while stretched over a heel of the shoe. Reinforcement to be only at the toe and or ball of the shoe providing a extra level of lower coefficient of friction than the bottom of the shoe and floor and a stabilization patch on the top of the fabric corresponding to the toe of the shoe, which has a higher coefficient of friction than the toe of the shoe and the material covering the shoe allowing, but not limited to, dancers and player of dance games to accomplish popular dance moves otherwise not able to attempt.

According to another aspect of the present invention, there is provided a method of moving on carpet including putting on a shoe, putting covering over the shoe, wherein the covering has a lower coefficient of friction than a bottom of the shoe, and moving on carpet.

BRIEF DESCRIPTION OF THE DRAWINGS

These and/or other aspects of the present invention will become apparent and more readily appreciated from the following description of the exemplary embodiments, taken in conjunction with the accompanying drawings, in which:

FIG. 3 illustrates how the bottom the sock of FIG. 2A is stretched over the heel of the shoe as shown in FIG. 2B and retracted back to cover the bottom of a shoe; FIG. 2A FIG. 4 illustrates an exemplary embodiment of a sock with directed reinforcement applied in a non stretched configuration;

DETAILED DESCRIPTION OF THE INVENTION

Figure 1:
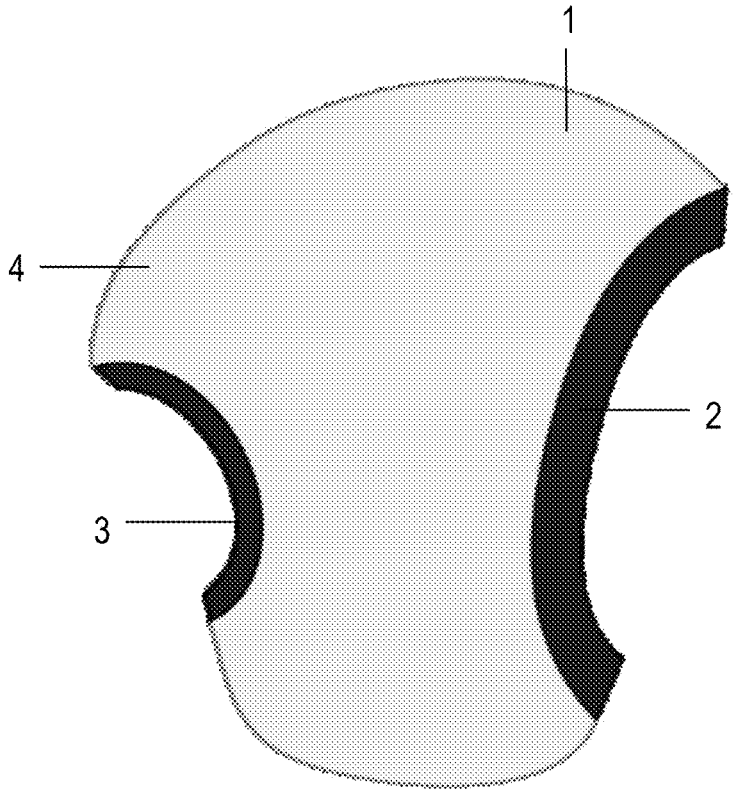
FIG. 1 illustrates an exemplary embodiment of a sock in a non-stretched configuration.

In the following description, same drawing reference numerals are used for the same elements in different drawings. The matters defined in the description, such as detailed construction and element descriptions, are provided to assist in a comprehensive understanding of the invention. In addition, well-known functions or constructions are not described in detail since they would obscure the invention with unnecessary detail.

FIG. 1 illustrates an exemplary embodiment of a sock 1 which has a first ring 2 which is made of a stretchable material. Sock 1 also has a second ring 3 which is made of a stretchable and retractable material with a softer yet flexible material 4 between and connecting the first ring 2 and the second ring 3 in a non-stretched configuration.

Figure 2A:
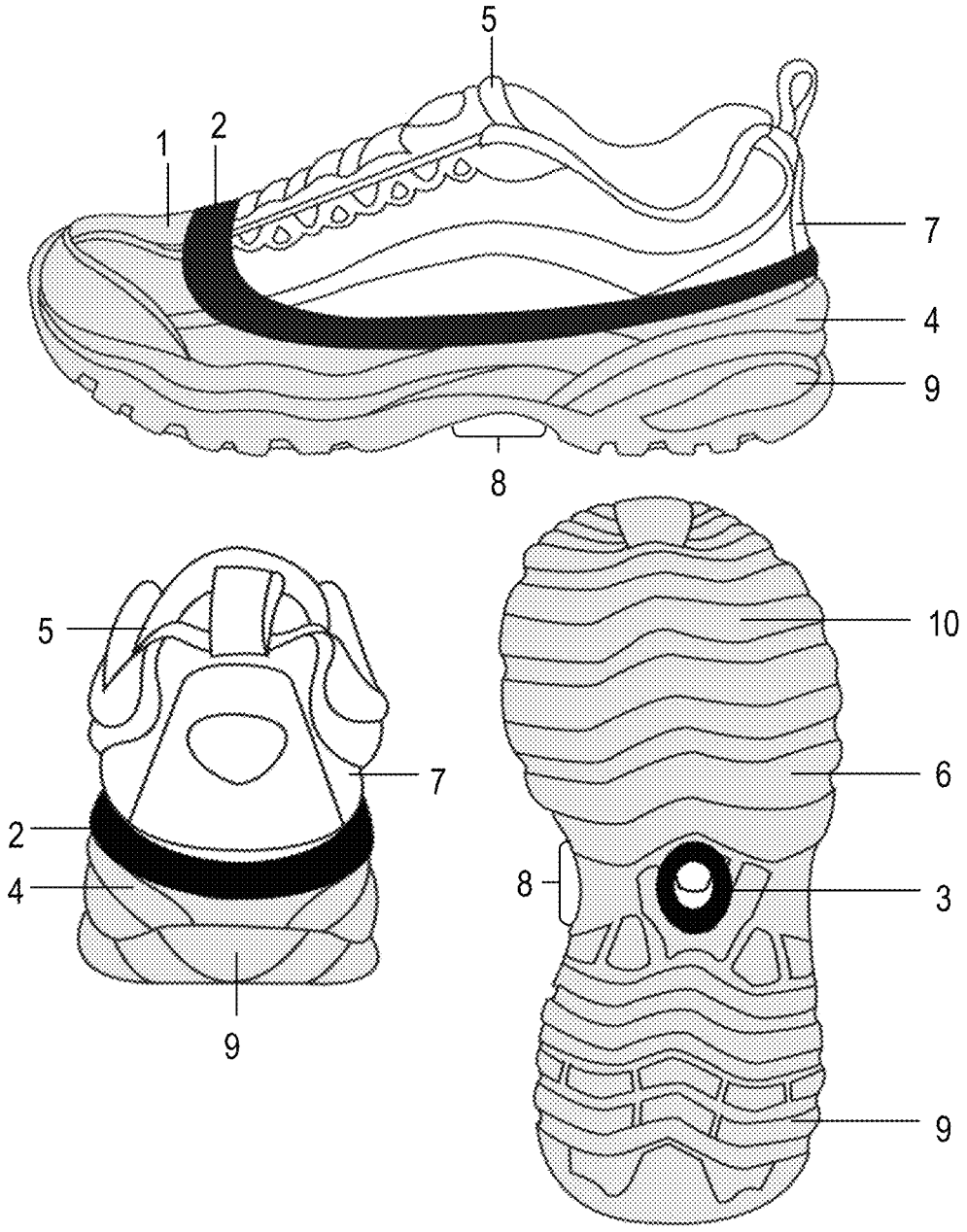
FIG. 2A illustrates the sock of FIG. 1 once it is fitted onto the shoe.

FIG. 2A illustrates an exemplary embodiment of a sock 1. In FIG. 2A the sock 1 is fitted completely around shoe 5. The shoe 5 has a bottom 6 which comprises the sole of the shoe and a top 7 which comprises all parts above the sole. The sock 1 is fitted on the shoe 5 by stretching the first ring 2 around the top of the shoe 7 and bottom of the shoe 6.

In FIG. 2A, the second ring 3 is in a non-stretched configuration at the bottom of the shoe 6 and located generally at the arch of the shoe 8. Therefore, when the second ring 3 is in the non-stretched configuration, the material 4 except for a portion of the arch 8 covers the bottom of the shoe 6 completely. Accordingly, when a wearer (not shown) wears the sock 1 with the second ring 3 in the non-stretched configuration, little or no portion of the bottom of the shoe 5 will directly contact a floor.

In addition, the material 4 has a lower coefficient of friction than the bottom of the shoe 3. Therefore, when a wearer puts on the sock 1 with the second ring 3 in the non-stretched configuration, the wearer is able to glide over a carpeted surface regardless of where the bottom of the shoe 6 meets the carpet or floor surface. Being able to glide allows the wearer (not shown) to better move with ease in any direction which might otherwise put undue stress on joints and muscles such as turning, twisting, pivoting and sliding. All such movements happen frequently throughout our daily routines or while exercising with or without a video within our own homes. Therefore, when a wearer puts on the sock 1 with the second ring 3 in the non-stretched configuration the wearer is able to move through their daily tasks, perform exercises and/or play interactive video games properly on carpeted surfaces with less risk of injury.

Figure 2B:
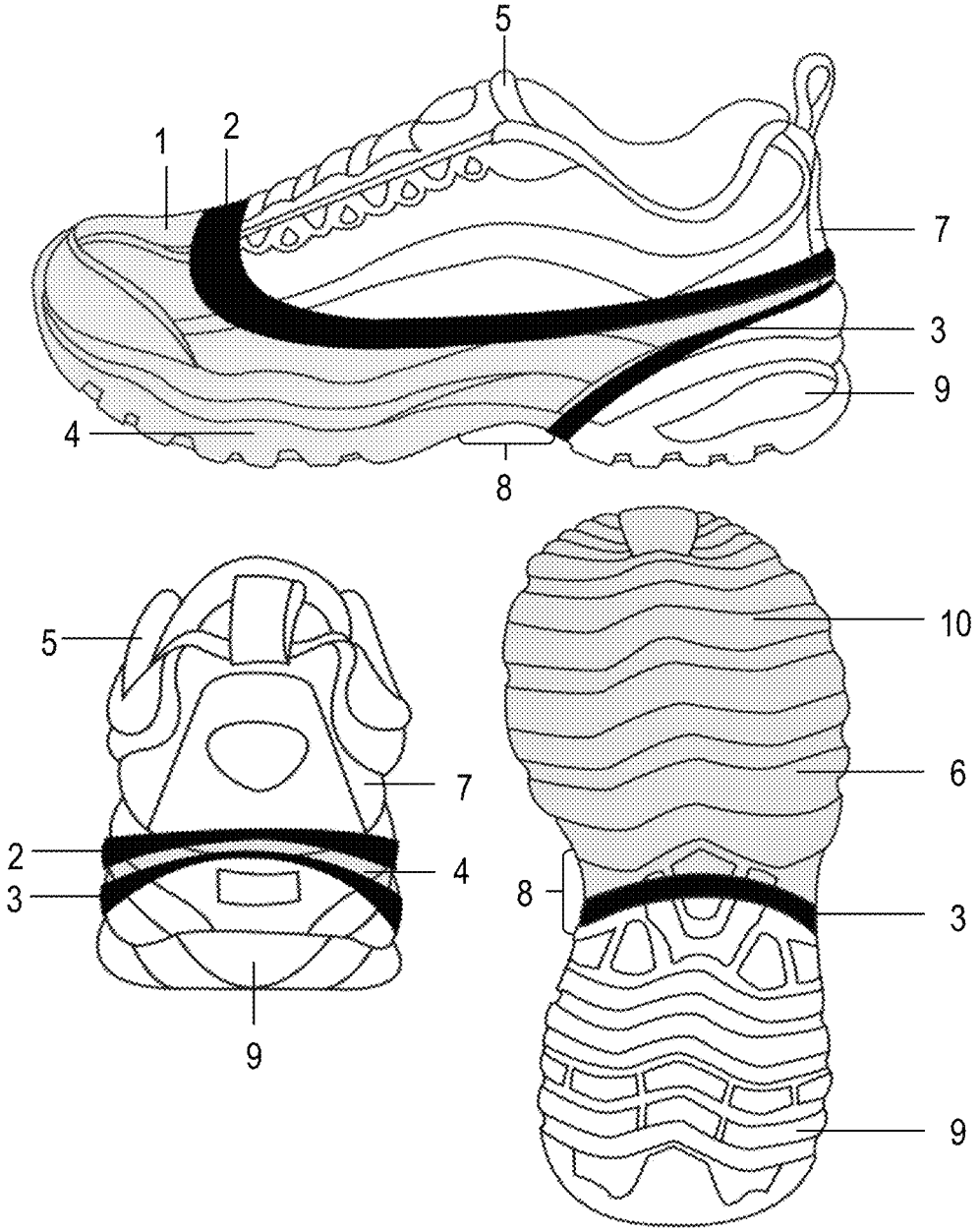
FIG. 2B illustrates the exemplary embodiment of FIG. 2A wherein the sock is pulled over a heel of the shoe.

FIG. 2B illustrates the exemplary embodiment of FIG. 2A wherein the second ring 3 is in a stretched configuration. Specifically, in the stretched configuration, the second ring 3 is stretched over the heel 9 of the shoe 5. When the second ring 3 is in the stretched configuration, a portion of the heel 9 that is provided on the bottom of the shoe 6 is not covered by the material 4 which gives the wearer more options and advantages.

For example, many exercises are more easily performed when the heel 9 grips the carpet harder than the ball portion 10 of the shoe 5. In the stretched configuration, a wearer is able but not limited to easily turning on the balls of his or her feet while still having the ability to stop at any moment when necessary using the heel 9.

In addition, a wearer may use the stretched configuration when he or she is moving on different types of surfaces. Different surfaces have different coefficients of friction. Since the sock 1 has a lower coefficient of friction than the bottom of the shoe 6, wearing the sock 1 on a surface with a lower coefficient of friction, such as a wood, tile or linoleum floor, may cause there to be too little fraction between the sock 1 and the said surface. In such a case, a wearer may feel insecure in their pursuit of movement. Therefore, by having the heel 9 not covered by the material 4 in the stretched configuration, the heel 9 creates more traction between the shoe 5 and the surface preventing accidental slipping or falling. Also, in the stretched configuration, a wearer will not have to take off the sock 1 in order to go between different types of surfaces.

Additionally, many people who use walkers, and especially older people, tend to lean forward putting as much of their body weight as possible on their walkers for support which takes weight off their lower body allowing them to pull their feet forward over the floor. Older people also tend to take off their shoes while inside because the weight of their shoes and drag on carpeted surfaces is problematical when trying to walk. However, by wearing a sock 1 in the stretched configuration, the sock 1 will allow their shoes to glide over the carpeted floor due to its lower coefficient of friction. Therefore, the person using the walker will not have to lean over as far or put so much of their body weight onto the walker to get the leverage necessary to move. By lessening the weight load on their upper body buy allowing them to glide over a surface instead of unavoidable gripping, the capability to stand up straighter is possible therefore can improve proper body mechanics, overall posture and lung capacity. Additionally, by having the heel 9 not covered by the material 4, greater traction is obtained at the heel 9, and there is less chance that the wearer will accidentally slip or fall while moving freely from one surface to another. It is also important to note that the above strategy can work for anyone who has ambulatory difficulty weather through but not limited to age, disability, or in recovery from an acute injury.

Furthermore, the second ring 3 is designed to be both stretchable from the non-stretched configuration to the stretched configuration and retractable from the stretched configuration to the non-stretched configuration. This allows for the sock 1 to be switched back and forth between full coverage of the bottom of the shoe 6 and exposing just the heel 9 of the shoe 5.

FIG. 3 shows the options available after fitting the sock 1 around the shoe 5 which places second ring in the arch of the shoe 8, on the bottom of the shoe 6. Once the second ring 3 in place the wearer has the ability to leave the second ring in the middle of the arch of the shoe 8 for full coverage of the material 4 on the bottom of the shoe 6, allowing for maximum gliding ability or stretch the second ring 3 down and over the heel 9, landing on the back 7, of the shoe 5 for more traction and support.

While FIG. 3 illustrates the steps being performed in this order, a person skilled in the art would understand that the steps may be performed in many other orders and certain steps may be performed simultaneously.

Figure 4:
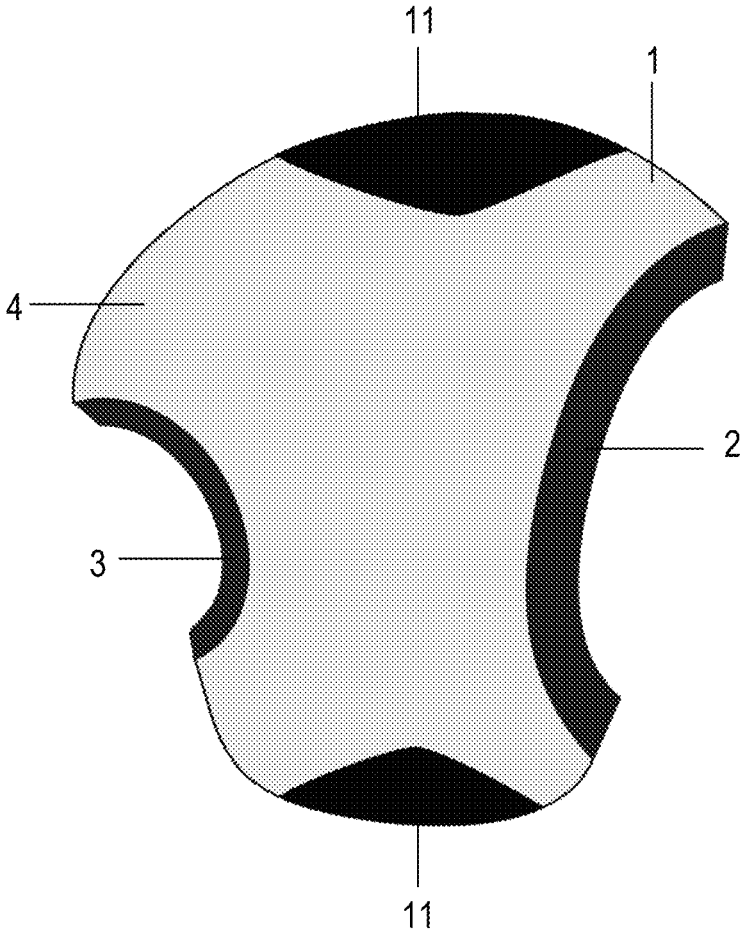

FIG. 4 illustrates an exemplary embodiment of a sock 1. Parts that are the same as those shown in FIGS. 1, 2A and 2B are identified by the same reference numerals and will not be explained again here. FIG. 4 additionally shows the reinforcement panels 11 provided on portions of the sock 1 which correspond, but are not limited to the heel of the shoe 9, the ball of the shoe 10 and or the toe of the shoe 11, in a non stretched configuration.

Figure 5A:
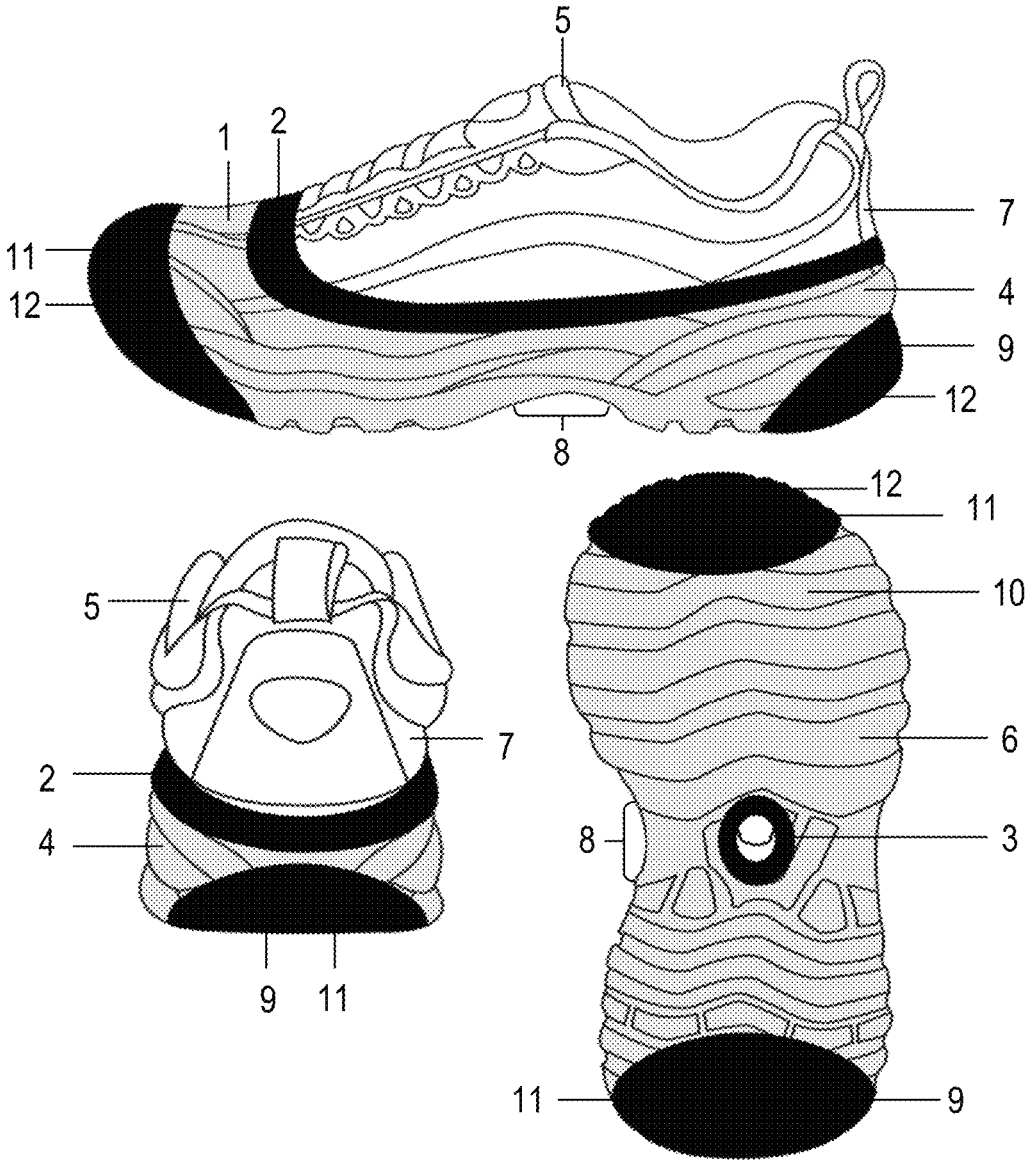
FIG. 5A illustrates the sock of FIG. 4 with directed reinforcement applied once it is fitted on the shoe.

FIG. 5A illustrates an exemplary embodiment of FIG. 4 of a sock 1. In FIG. 4, the reinforcement 11 is shown at the portions of the sock 1 which correspond to the toe 12 and the heel 9 of the shoe 5. However, the reinforcement 11 can be provided in many different configurations. One example would be such as going around the entire shoe 5, so long as the reinforcement 11 is provided at either a portion of the sock 1 that corresponds to the heel 9 of the shoe 5 or a portion of the sock 1 that corresponds to the ball 10 of the shoe 5 or a portion of the sock 1 that corresponds to the toe 12 of the shoe 5. In addition, the reinforcement 11 has a lower coefficient of friction then the bottom of the shoe 6, but may have a different coefficient of friction than the rest of the material 4.

Providing reinforcement 11 on portions of the sock 1 which corresponds to a toe 12 and the heel 9 of the shoe 5 allows for the improvement of a variety of exercises and better performance when the reinforcement 11 has a different coefficient of friction than the rest of the material 4. For example, by having reinforcement 11 at a toe 12, push-ups become a full body exercise due to the lack of grip on the floor from the toes of the shoes. Without gripping the floor, the wearer must use more than just their normal upper body strength to complete the exercise. The entire abdominal wall along with the muscles of the back, legs and gluteus must engage for the toes of the shoes not move backwards with the up and down motion of the push-up. If someone is not strong enough for such an advanced exercise, he or she can still use the sock 1 with the reinforcement 11 from an easier approach, yet still challenging. For example, a wearer would start in a boxed push-up position with their elbows and knees on the floor and toes under. Keeping their elbows on the floor they then would push one leg out straight and then the other one out to meet the first one At this point both legs are in a straight position behind them. Using their body strength to stay in that position is challenging since the grip of their toes will be less than what they are use to with the reinforcement 11 on the toe 12 of shoe 5. Taking it one step further, from previous position, the wearier could allow the sliding ability of the sock 1 with the reinforcement 11 to take them back a few inches further without moving their elbows or bending their knees and then using their abdominal, upper back and shoulder muscles, pull themselves back to the beginning position using the gliding ability given from the reinforcement 11 being placed on the toe 12 of shoe 5.

In addition, by having reinforcement 11 at the heel 9, a wearer regardless of ability, can turn supine and start working their abdominal muscles by pushing their heels forward and back on the carpet or known surface. This is an especially good option for obese or over weight individuals because their legs never leave the ground and the hip flexor muscles do not engaged. Therefore, participants will not experience the common pain that comes from improper positioning due to a lack of strength and or too much stress being applied. Even for people who consider themselves fit will get an intense core workout from pushing their heels forward on the floor instead of driving their legs up.

By making the reinforcement 11 with a different coefficient of friction than the rest of the material 4, one can choose the amount of force needed to perform a given exercise in order to optimize the workout. The coefficient of friction of the reinforcement 11 may be either higher or lower than the rest of the material 4 allowing for many options in manufacturing for different physical abilities and disabilities.

Figure 6A:
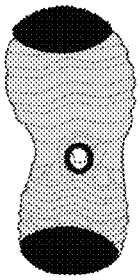
FIG. 6 illustrates how the bottom the sock of FIG. 5A is stretched over the heel of the shoe as shown in FIG. 5B and retracted back to cover the bottom of a shoe FIG. 5A.
Figure 6B:
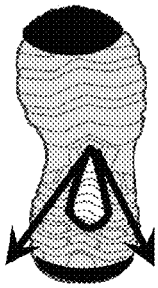
Figure 6C:
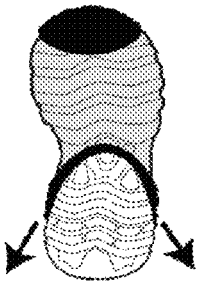
Figure 6D:
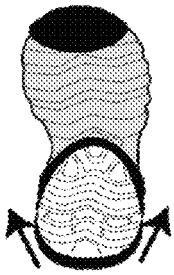
Figure 6E:
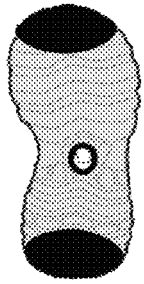
Figure 6:
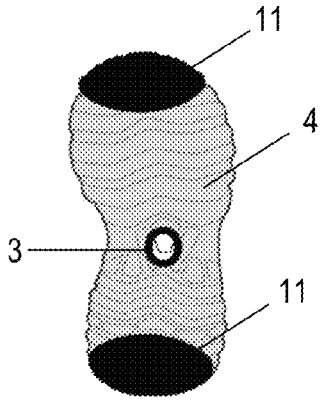

FIG. 6 shows the options available after fitting the sock 1 around the shoe 5 which places second ring in the arch of the shoe 8, on the bottom of the shoe 6 with the applied reinforcement. Once the second ring 3 in place the wearer has the ability to leave the second ring in the middle of the arch of the shoe 8 for full coverage of the material 4 on the bottom of the shoe 6, allowing for maximum gliding ability or stretch second ring 3 down and over the heel 9 for more traction and support.

While FIG. 6 illustrates the steps being performed in this order, a person skilled in the art would understand that the steps may be performed in many other orders and certain steps may be performed simultaneously.

Figure 7:
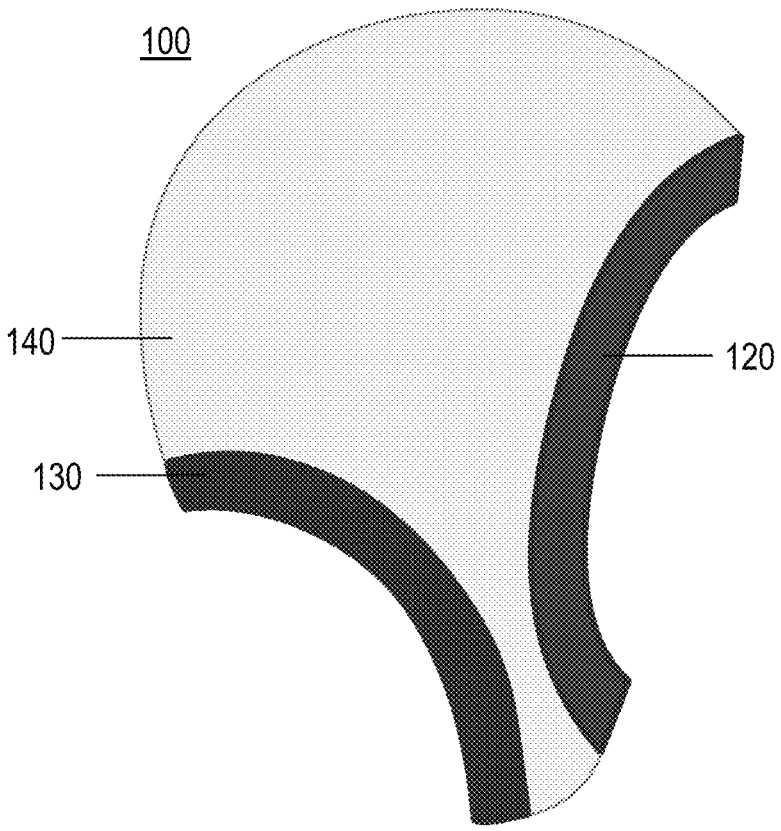
FIG. 7 illustrates another exemplary embodiment of a sock in a non-stretched configuration without the shoe.

FIG. 7 illustrates another exemplary embodiment. In FIG. 7, a sock 100 is illustrated. The sock 100 has a first ring 120 and second ring 130. The first ring 120 is made to be stretchable. The second ring 130 is also made to be stretchable but not retractable back to a small hole as illustrated in FIG. 3 of sock 1. Soft flexible material 140 runs continuously from the first ring 120 and the second ring 130 creating but not limited to a sock like structure. In FIG. 7, a sock 100 is illustrated in a non-stretched configuration.

Figure 8:
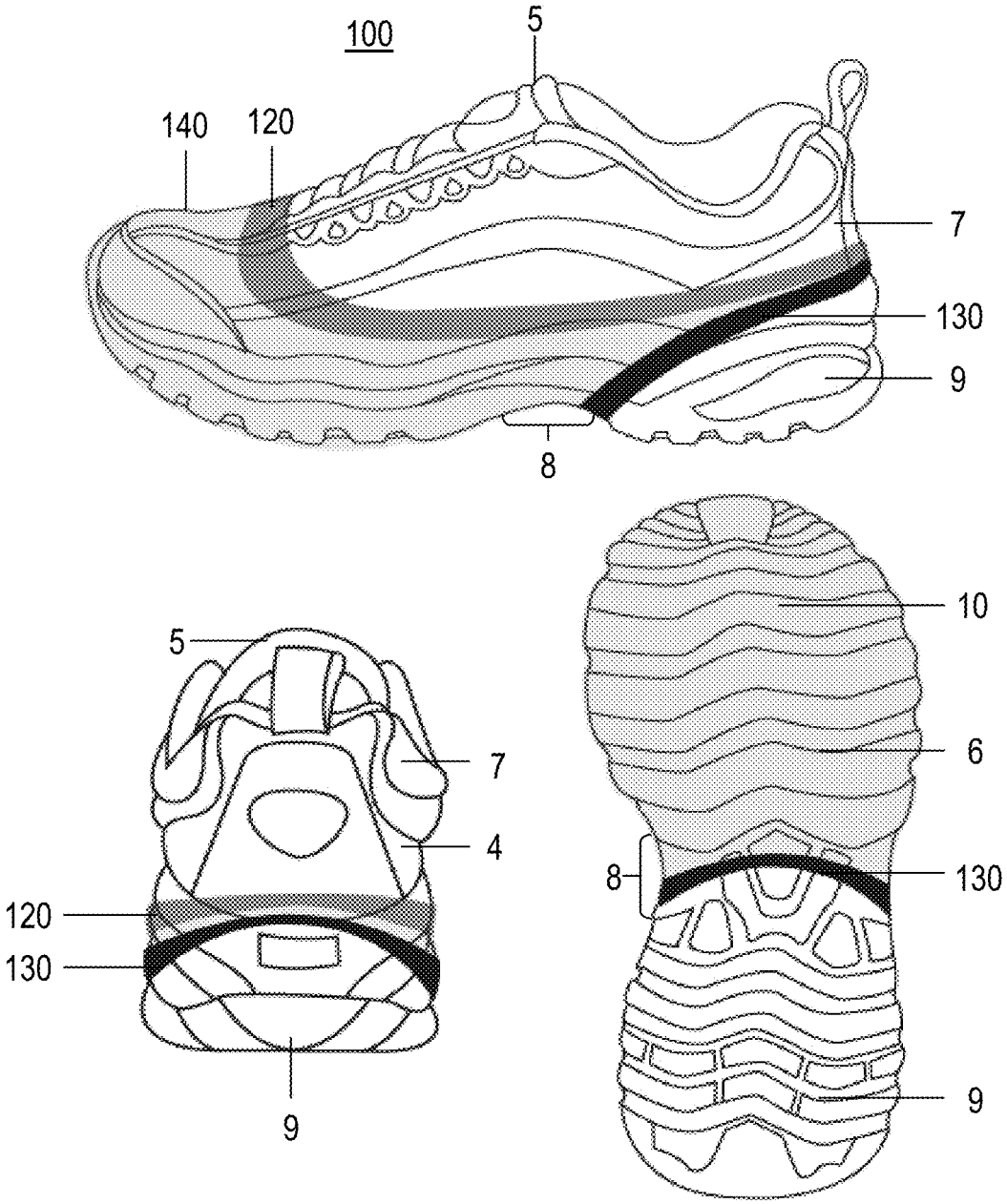
FIG. 8 illustrates the sock of FIG. 7 once it is fitted on the shoe; wherein the sock is pulled over a heel of the shoe.

FIG. 8 illustrates the exemplary embodiment of FIG. 7 wherein the second ring 130 is in a non retractable stretched configuration. Specifically, in the stretched configuration, the second ring 130 is stretched over a heel of the shoe 9. When the second ring 130 is in the stretched configuration, the heel 9 that is provided on the bottom of the shoe 6 is not covered by the material 140 which has similar advantages to the sock 1 illustrated in FIG. 2B. Additionally, the sock 100 has an additional advantage of being easier to manufacture.

Figure 9:
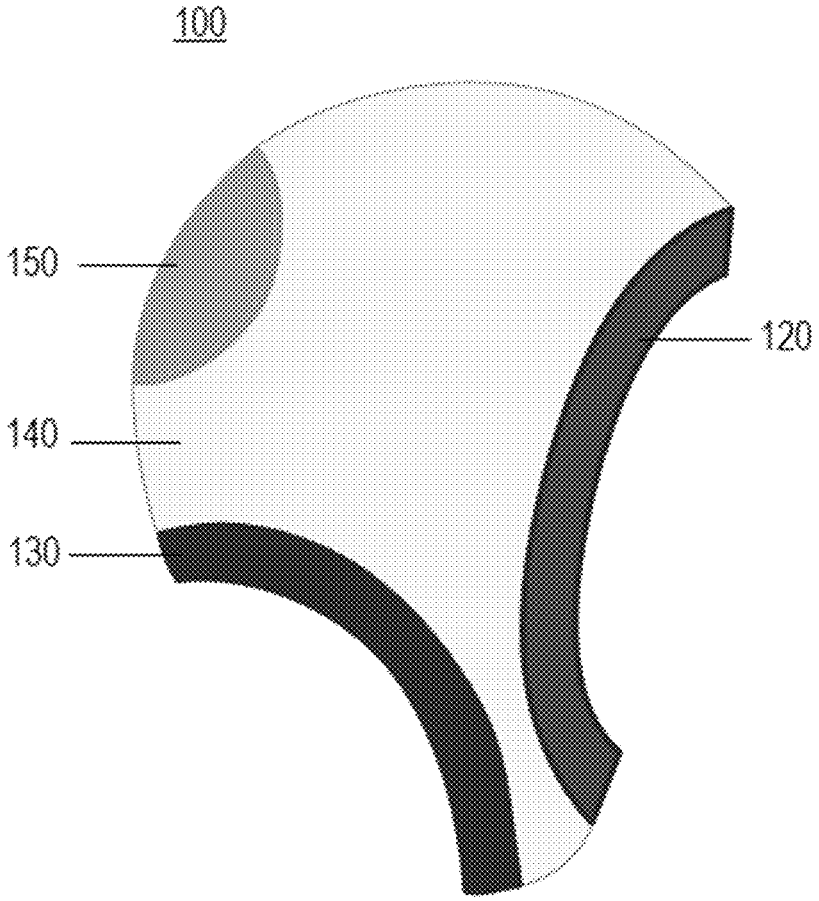
FIG. 9 illustrates another exemplary embodiment of a sock with directed reinforcement applied in a non-stretched configuration without the shoe.
Figure 10:
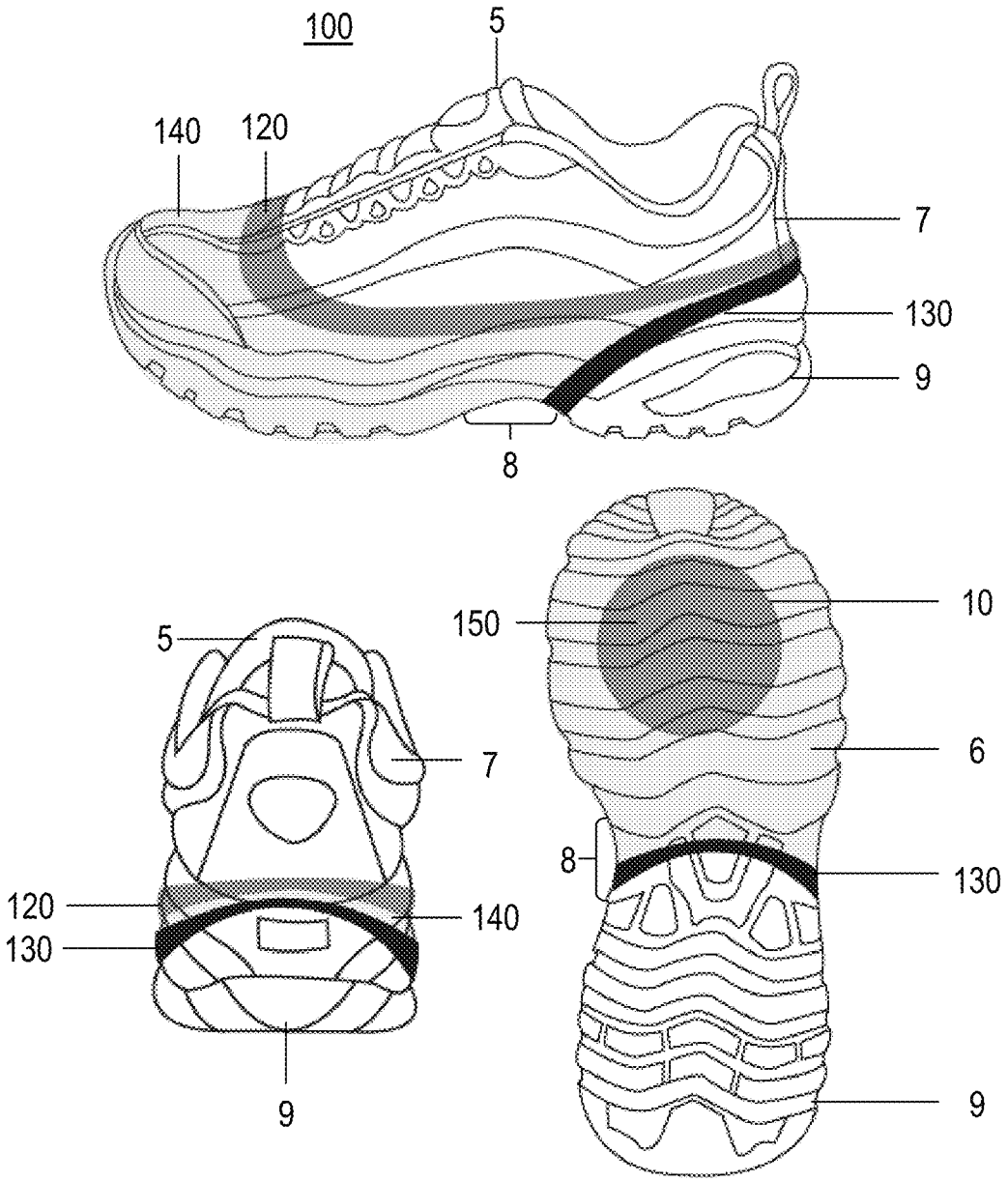
FIG. 10 illustrates the sock of FIG. 9 with directed reinforcement applied wherein the sock is pulled over a heel of the shoe.

FIGS. 9 and 10 illustrate another exemplary embodiment of the sock 100. Parts that are the same as those shown in FIGS. 7 and 8 are identified by the same reference numerals and will not be explained again here. FIG. 9 additionally shows the reinforcement 150 provided on portions of the sock 100 which correspond, but are not limited to the ball of the shoe 10 in a non stretched configuration.

Figure 5B:
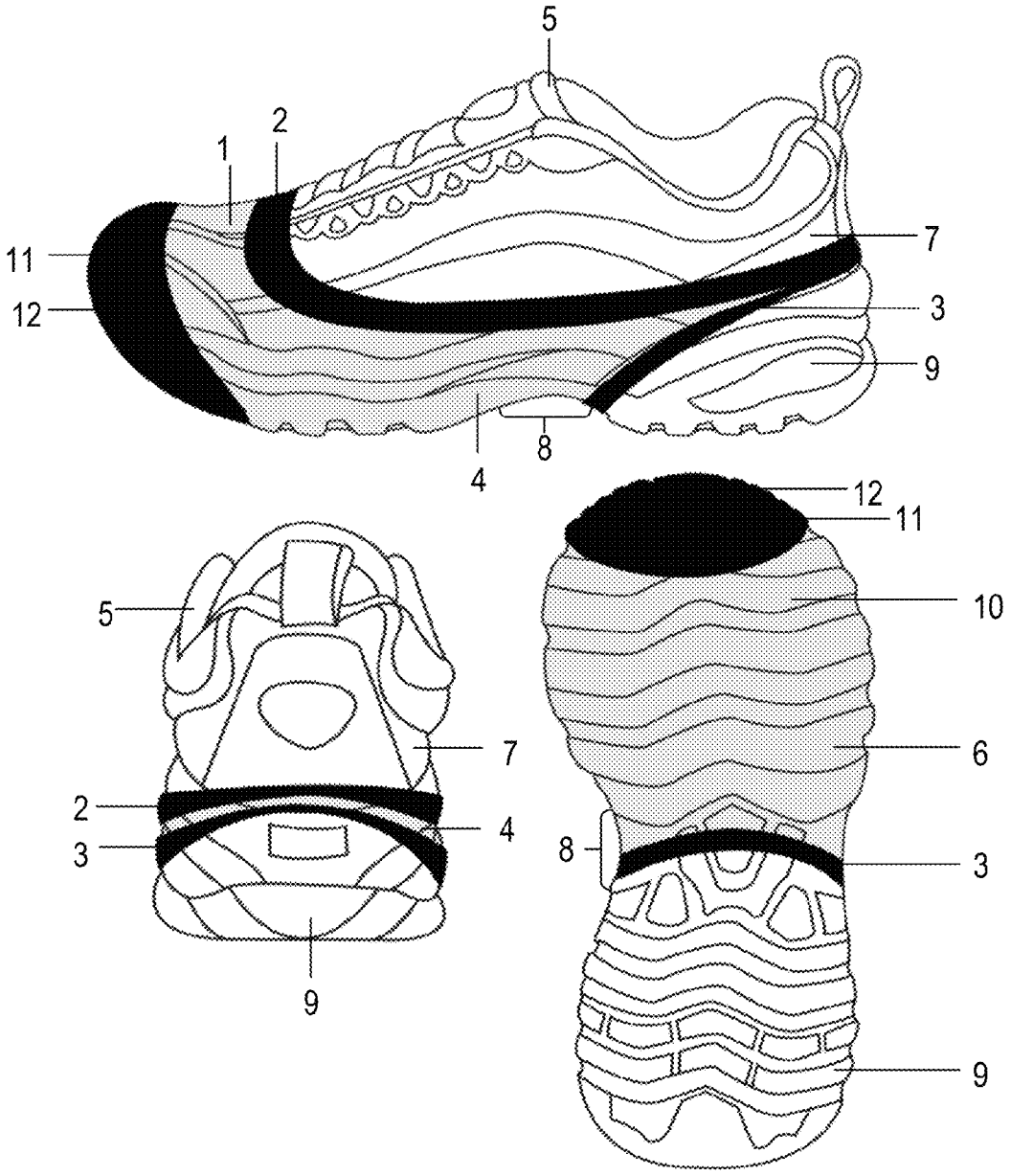
FIG. 5B illustrates the exemplary embodiment of FIG. 5A with directed reinforcement applied wherein the sock is pulled over a heel of the shoe.

FIG. 10 illustrates the exemplary embodiment of FIG. 9 wherein the second ring 130 is in a non retractable stretched configuration. The additional reinforcement 150 is shown only at the portions of the sock 100 which correspond to the ball 10 of the shoe 5 in a stretched configuration. However, the reinforcement 150 can be provided in any way, such as going around the entire shoe or the reinforcement 150 can be a full panel of different fabric so long as the reinforcement 150 once fitted on a shoe is provided at or in addition to either a portion of the sock 100 that corresponds to the ball 10 of the shoe 5 or a portion of the sock 100 that corresponds to toe 9 of the shoe 5. In addition, the reinforcement 150 has a lower coefficient of friction then the bottom of the shoe 6, but may have a different coefficient of friction than the rest of the material 140. Furthermore, providing the reinforcement 150 has similar advantages to providing the reinforcement 11 as illustrated in FIG. 5B.

Figure 11:
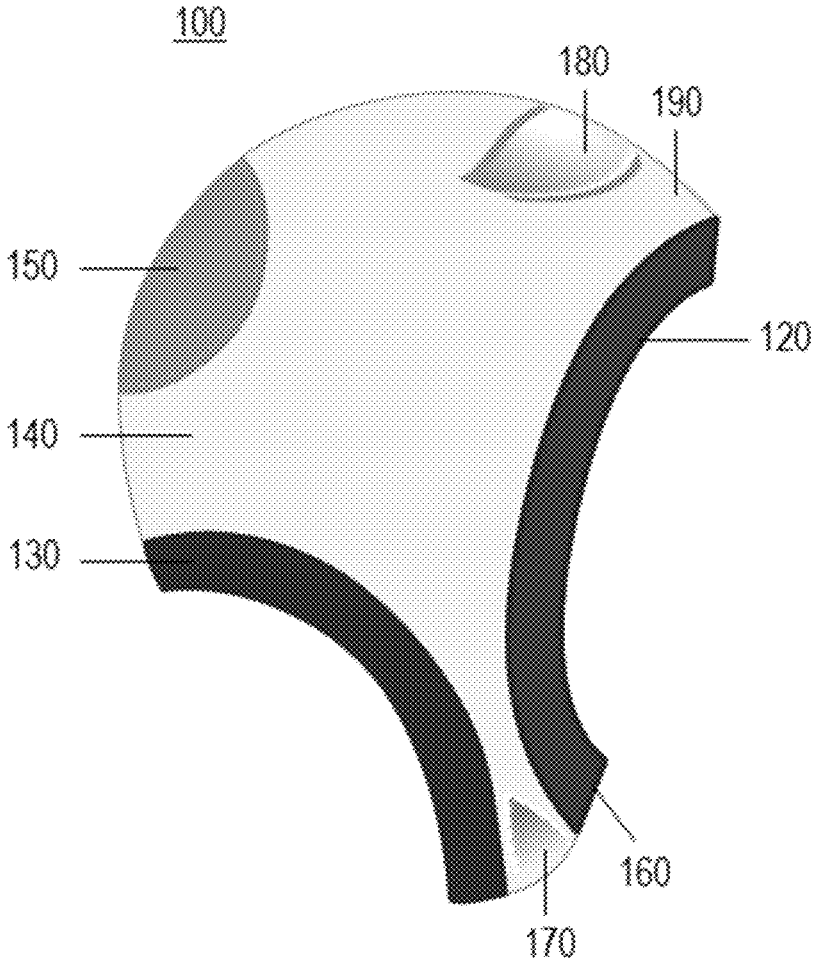
FIG. 11 illustrates the exemplary embodiment of FIG. 9 with additional directed patches applied in a non-stretched configuration without the shoe.
Figure 12:
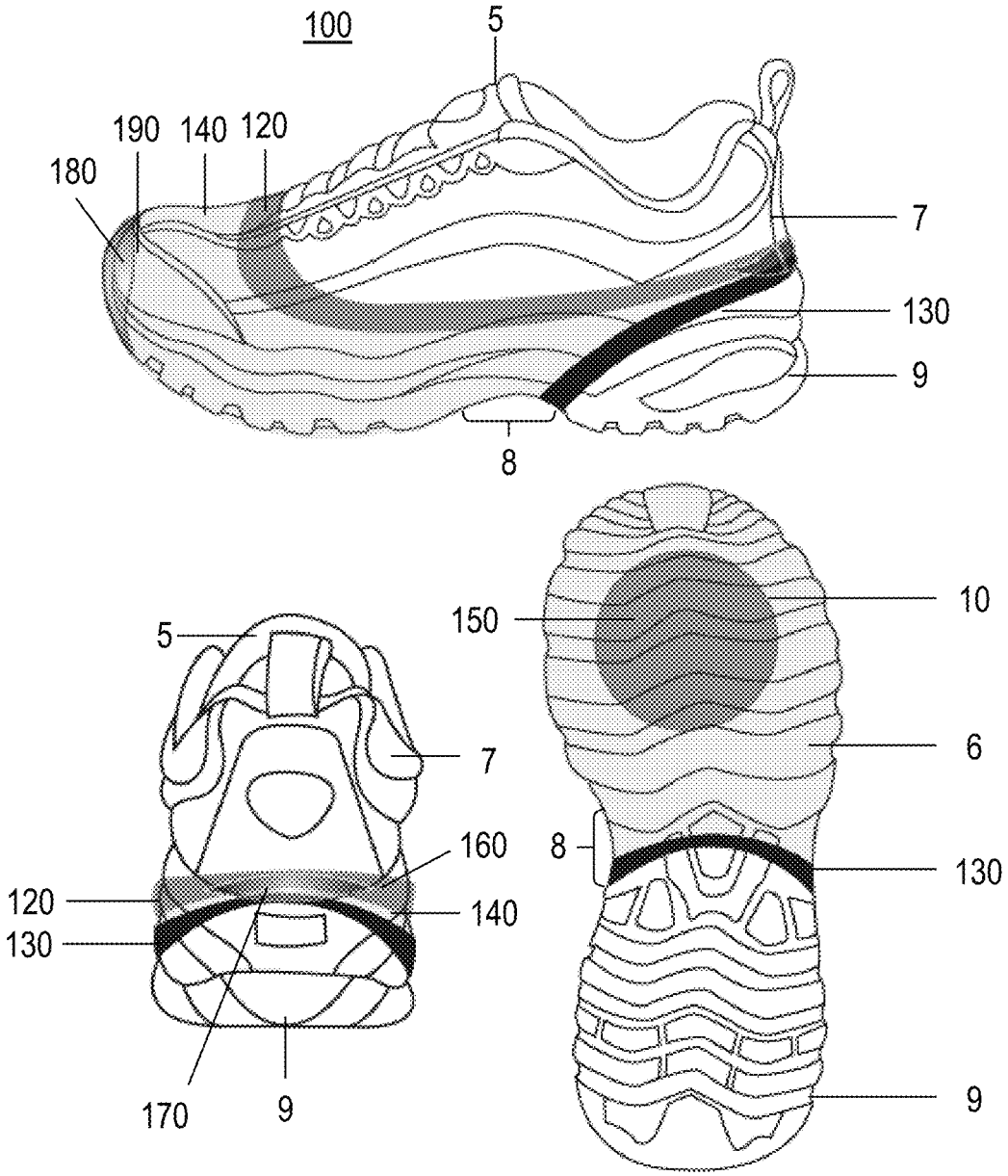
FIG. 12 illustrates the exemplary embodiment of FIG. 9 with additional directed patches applied wherein the sock is pulled over a heel of the shoe.

FIGS. 11 and 12 illustrate another exemplary embodiment of the sock 100. Parts that are the same as those shown in FIGS. 7, 8, 9 and 10 are identified by the same reference numerals and will not be explained again here. FIGS. 11 and 12 additionally show a positioning patch 160 provided on the inside of the sock 170 which will be placed against, but is not limited to the upper back 7 of the shoe 5. FIGS. 11 and 12 also additionally show a stabilization patch 180 provided on the outside of the sock 100 which corresponds, but is not limited to the toe of the sock 190. FIG. 11 shows these additions in a non stretched configuration.

FIG. 12 illustrates the exemplary embodiment of FIG. 11 wherein the second ring 130 is in a non retractable stretched configuration. Providing the additional positioning patch 160 is to aid in proper fit of sock 100 due to the higher coefficient of friction than the material 4. Although sock 1 and sock 100 is structured small in size so as to be applied tightly when stretched, some shoes are much smaller than others and would benefit from the positioning patch 160 to help keep the second ring 130 from a possible loose fit around shoe 5.

FIG. 12 also illustrates the additional stabilization patch 180 which is slightly bigger than the positioning patch 160, and has a higher coefficient of friction than the material 140, is shown on outside of the sock 100 which corresponds to the toe of the sock 190 and utilized by the toe 12 of the shoe 5. The stabilization patch will help, but not limited to, dancers and/or the dance game participant who would like to accomplish specific and/or popular dance moves which would require a moment to balance on, but not limited to, the toes of one's shoes. Special and expensive shoes are normally required to attempt such dance moves. With the stabilization patch, professionals, armatures, the home dance enthusiast or dance video/game player will be able to not only attempt such unreachable moves in, but not limited to their homes, they'll be able practice enough that the possibly of mastering them will finally be within reach.

While the present invention has been particularly shown and described with reference to exemplary embodiments thereof, it will be understood by those of ordinary skill in the art that various changes in form and details may be made therein without departing from the spirit and scope of the present invention as defined by the following claims.

For example, the material 4 of sock 1 or the material 140 of sock 100 may be made from materials such as nylon, spandex, Lycra, polyester and/or cotton but the material 4 of sock 1 or the material 140 of sock 100 is not limited to those materials. Also, the material 4 of sock 1 or the material 140 of sock 100 may be made from a blend of material. Further, the first and second rings 2 and 3 of sock 1 and the first, second, and third rings 120, 130 of sock 100 may be made of the same as material 4 of sock 1 or the material 140 of sock 100 as the rest of the sock, a different material, or the same material but reinforced at the rings or full panels. Also the positioning and stabilization patches may be made of but not limited to silicone rubber. Additionally, while it is preferable for the bottom of the shoe 6 to be completely covered by the material 4, except for a portion of the arch 8, when the second ring 3 of sock one or the second ring 130 of sock 100 is in the non-stretched configuration, some portion of the bottom of the shoe 6 besides the arch 8 may be exposed and still be within the present invention. Also, the term ring used in this specification is not limited to a circular ring and can be any shape such as an oval, square, or any other type of geometric figure so long as the ring is closed or it can be a tighter material woven into the fabric and not separated. Furthermore, it is preferable for the sock 1 or 100 to have the general shape of a sock, tube, or a combination thereof with or without a closed or open heel.

What is claimed is:

1. A sock fittable on a shoe, comprising:

a first ring having a first circumference when non-stretched and a second circumference when stretched, said first ring being stretchable to admit at least a portion of a front of the shoe and a portion of a bottom of the shoe, a second ring having a third circumference when non-stretched and a fourth circumference when stretched, and a tube of stretchable material sized to fit on a shoe connecting and having at opposite ends the first ring and the second ring, said tube having a first cross-sectional circumference when non-stretched which is greater than both first circumference and said third circumference and a second cross-sectional circumference when stretched which is greater than both said second circumference and said fourth circumference, wherein said tube is stretchable to non-retractably cover at least the bottom of the shoe in front of an arch of the shoe such that at least the bottom of the shoe in front of the arch does not directly contact a floor surface, wherein the second ring is stretchable between a non-stretched configuration such that the stretchable material covers at least a portion of a heel of the shoe behind the arch and a stretched configuration such that the second ring is stretched over the heel of the shoe, and wherein said stretchable material is a material selected from the list consisting of nylon, spandex, and a blend of nylon and spandex.

2. The sock of claim 1, wherein the second ring is stretchable to a configuration such that the bottom of the shoe in front of the arch is non-retractably covered by the tube and a heel of the shoe behind the arch is not covered by the tube.

* * * * *